US006499610B2

(12) United States Patent
Spitsbergen

(10) Patent No.: US 6,499,610 B2
(45) Date of Patent: Dec. 31, 2002

(54) PORTABLE HOIST SYSTEM

(76) Inventor: Michael Spitsbergen, P.O. Box 6433, Abilene, TX (US) 79605

( * ) Notice: Subject to any disclaimer, the term of this patent is extended or adjusted under 35 U.S.C. 154(b) by 23 days.

(21) Appl. No.: 09/992,508

(22) Filed: Nov. 6, 2001

(65) Prior Publication Data

US 2002/0066710 A1 Jun. 6, 2002

Related U.S. Application Data

(63) Continuation-in-part of application No. 09/611,007, filed on Jul. 6, 2000, now abandoned.
(60) Provisional application No. 60/145,391, filed on Jul. 23, 1999.

(51) Int. Cl.[7] ..... B66C 23/26
(52) U.S. Cl. ..... 212/179; 212/280; 212/270; 212/901
(58) Field of Search ..... 212/179, 180, 212/901, 270; 414/543, 462; 182/142–146

(56) References Cited

U.S. PATENT DOCUMENTS

| | | | | | |
|---|---|---|---|---|---|
| 873,076 | A | | 12/1907 | Olsen et al. | 212/901 |
| 2,487,305 | A | | 11/1949 | Bridegroom | 212/145 |
| 2,496,401 | A | | 2/1950 | McKinney | 212/65 |
| 2,592,993 | A | | 4/1952 | Adams | 212/65 |
| 2,670,086 | A | | 2/1954 | Eisberg | 212/65 |
| 2,888,111 | A | | 5/1959 | Evans | 189/26 |
| 3,802,653 | A | | 4/1974 | Nyulassie | 248/43 |
| 3,879,907 | A | | 4/1975 | Olson | 52/297 |
| 4,030,733 | A | | 6/1977 | Merrihew et al. | 273/29 |
| 4,600,348 | A | | 7/1986 | Pettit | 414/11 |
| 4,714,226 | A | | 12/1987 | Tracy | 240/544 |
| 4,833,566 | A | | 5/1989 | Nickola | 361/369 |
| 4,880,346 | A | * | 11/1989 | Brassette | 414/486 |
| 5,211,297 | A | * | 5/1993 | Vandervalk | 212/182 |
| 5,445,281 | A | | 8/1995 | Hung | 212/179 |
| 5,445,487 | A | | 8/1995 | Koscinski, Jr. | 414/543 |
| 5,456,433 | A | | 10/1995 | Burns et al. | 248/148 |
| 5,752,799 | A | * | 5/1998 | Carey et al. | 414/543 |
| 5,788,095 | A | * | 8/1998 | Watson | 212/180 |
| 5,800,117 | A | * | 9/1998 | Milton | 414/540 |
| 5,816,554 | A | | 10/1998 | McCracken | 248/346.01 |
| 6,138,991 | A | * | 10/2000 | Myers | 212/180 |
| 6,152,675 | A | * | 11/2000 | Compton | 414/543 |

* cited by examiner

*Primary Examiner*—Thomas J. Brahan
(74) *Attorney, Agent, or Firm*—Jenkens & Gilchrist, A Professional Corporation

(57) ABSTRACT

A portable hoist system includes a base assembly which includes a pintle. Slidably mounted over the pintle is a hoist support assembly. The hoist support assembly includes a substantially vertical tube which is connected at its top portion to a support arm. The support arm is supported with respect to the substantially vertical tube by an angled brace member. On the top of the support arm is located a lifting strap control assembly. The lifting strap control assembly includes a windlass and a guide bar.

9 Claims, 9 Drawing Sheets

PORTABLE HOIST SYSTEM

This application claims the benefit of U.S. Provisional Patent Application No. 60/145,391 filed Jul. 23, 1999 and is a continuation-in-part of U.S. patent application Ser. No. 09/611,007 filed Jul. 6, 2000 now abandoned.

FIELD

The present invention relates to a portable hoist system; more particularly the portable hoist system of the present invention relates to a lifting hoist which may be used on the top of a building, in the cargo space of a vehicle, or on any other application where a light weight portable hoist usable by an individual is required.

BACKGROUND

In many small to medium sized buildings, air conditioning units for the building are located on the roof. Typically these air conditioning units weigh between 150 and 200 pounds. When it is necessary to change the air conditioning unit or remove it for repair, it is often necessary for the owner of the building to hire a crane service or possibly a helicopter service to lift the air conditioning unit from the roof and then place it on the ground or unto a truck. Alternatively, smaller air conditioning units may be manually lifted from the top of the building, carried over to a ladder resting alongside the building and then slid down the ladder to the ground or to an awaiting truck.

In other situations it is often necessary for owners of pickup trucks to place a load in a cargo space such as the bed of the truck—which load is not easily lifted manually by one or two people. One solution to this problem has been the creation of hydraulic systems which raise and lower a platform from ground level to the level of the truck bed. While first used on large commercial vehicles, these lifts have become smaller over the years and are now sized to be used on pickup trucks and large vans. One manufacturer of these hydraulic liftgates sells them under the brand TommyLift™. While hydraulic liftgates enable the lifting of heavy loads, such systems are expensive and complex, as they include not only a mechanical system of arms and levers, but the hydraulics needed to provide the lifting power and an electrical system to control the operation of the hydraulic lifting system. Accordingly, a hydraulic liftgate system is typically too expensive and too complex for the vehicle owner who does not lift heavy loads on a regular basis. One category of such vehicle owner carries small motorcycles, jet skis or four-wheelers in the bed of their trucks. If help is not available, it is all but impossible for a single individual to unload a motorcycle, a jet ski, or a four-wheeler from the bed of a pickup truck.

A similar situation occurs with the use of an automobile. Oftentimes it may be necessary for the owner of an automobile to load heavy cargo into the trunk. But unlike hydraulic liftgates for trucks, there are no hydraulic systems available for automobiles which facilitate placing a load into the trunk of an automobile.

Small power boat owners also encounter lifting problems with outboard motors or inboard motors. Sailboat owners may experience lifting problems with heavy center boards, mast, booms, or rigging.

Many people who occasionally haul heavy cargo with an automobile or a truck find it handy to load the cargo onto a trailer and then tow the trailer to their destination. But the problem remains of loading and unloading heavy cargo from the trailer.

In the bed of pickup trucks, in the trunks of automobiles, on trailers, in the back of vans, in boats, and on the tops of small buildings, it is not practical or economical to mount a permanent hoist for the lifting of loads. Accordingly, there remains a need in the art for a portable hoist system which may be easily installed on the top of a building, in the bed of a truck, in the trunk of an automobile, in the back of a van, in boats, on a trailer, and in other similar applications and which is light-weight, easily assembled, inexpensive, may be easily moved from place to place by one person, thereby providing an individual with the ability to lift loads generally requiring more than one person to properly manage.

SUMMARY

The portable hoist system of the present invention is a light-weight, easily assembled, inexpensive system which may be easily moved from place to place by one person, thus providing an individual with the ability to move loads to or from the roof of a building or to or from the cargo space of a vehicle, a trailer, or any other type transport system.

The portable hoist system of the present invention has a base assembly which includes either a pintle mounted to a plate or a support for a substantially vertical tube. The substantially vertical tube is connected at its top portion to a support arm. The support arm is supported with respect to the substantially vertical tube by an angled brace member. On the top of the support arm is located a cable or strap assembly. The cable or strap assembly includes a windlass and a guide bar or rotating spool.

BRIEF DESCRIPTION OF THE DRAWINGS FIGURES

A better understanding of the portable hoist system of the present invention may be had by reference to the drawing figures wherein.

Figure 13A:
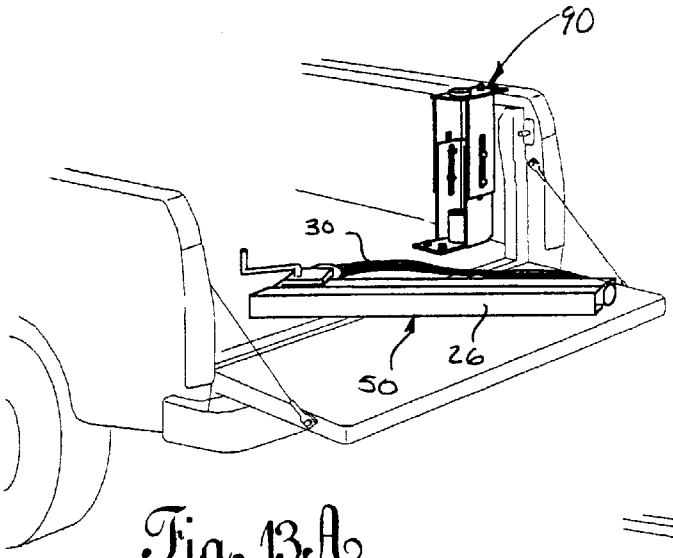
Figure 13B:
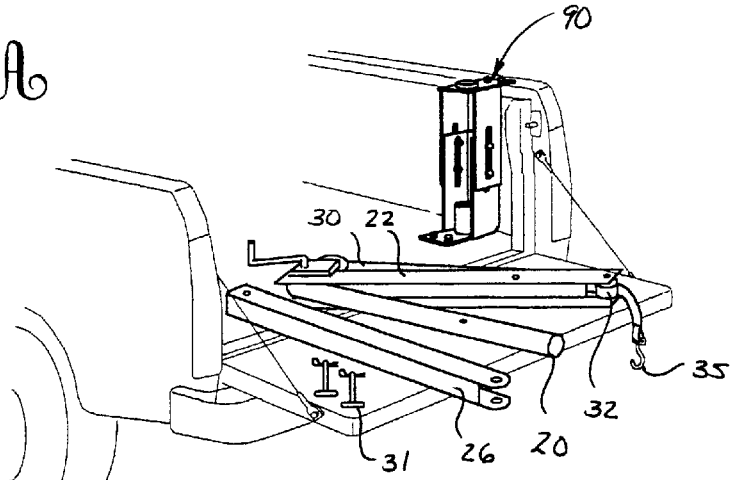
Figure 13C:
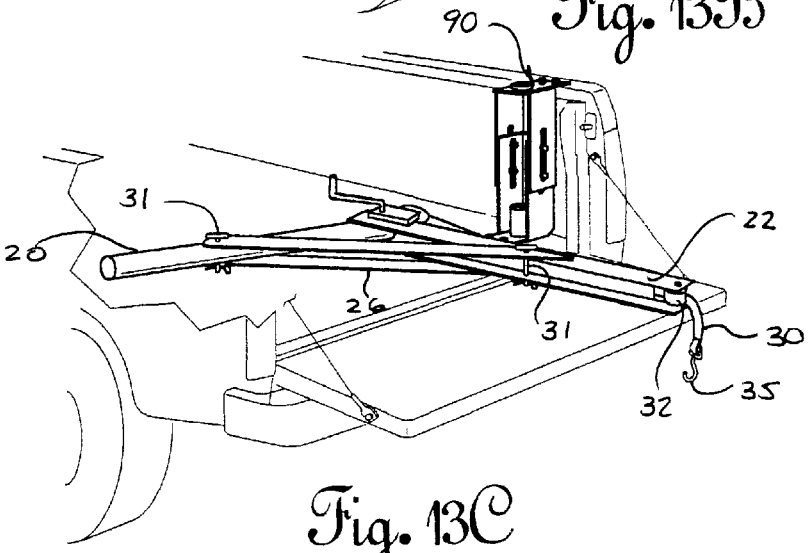
Figure 14:
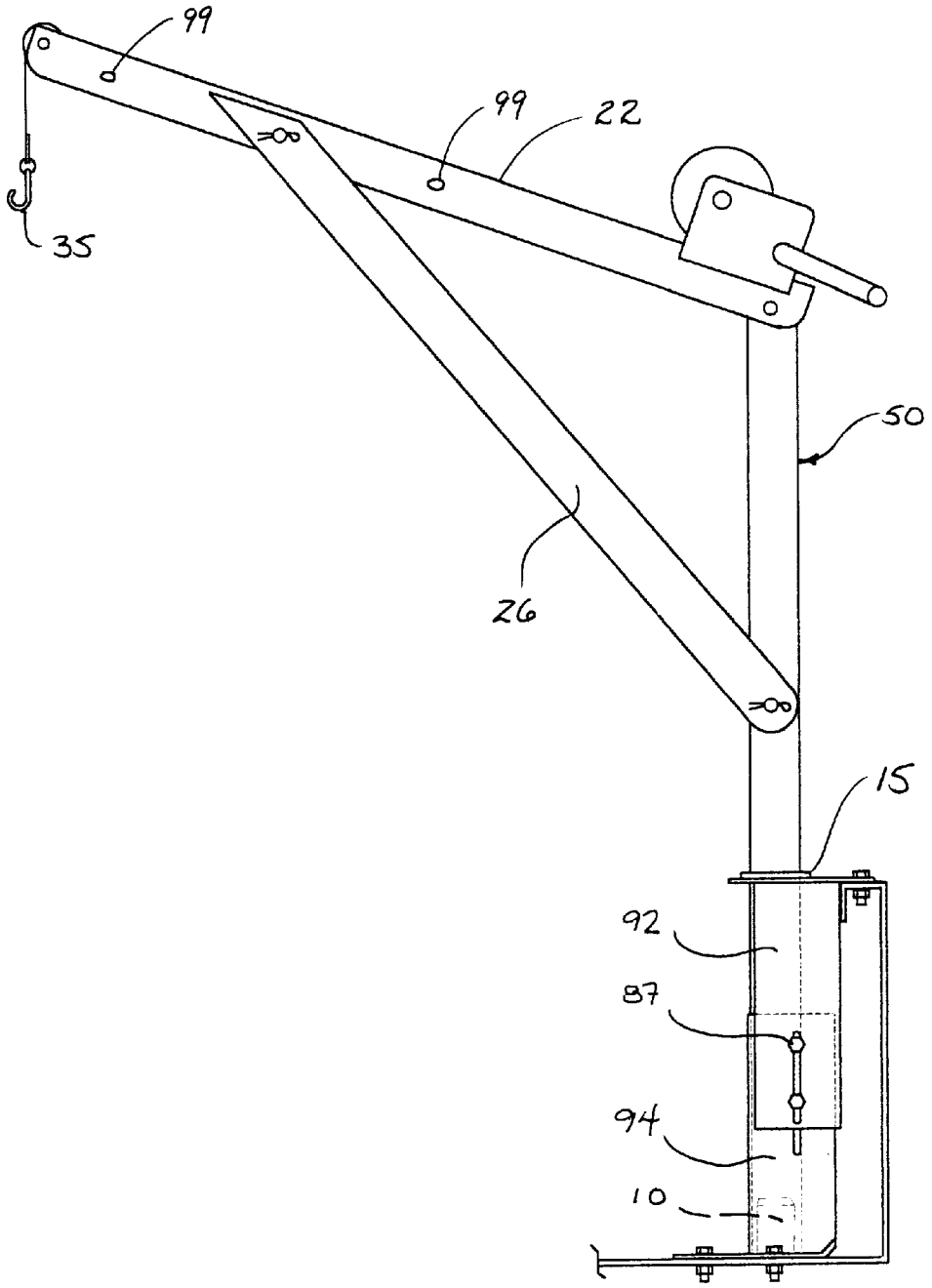
Figure 15A:
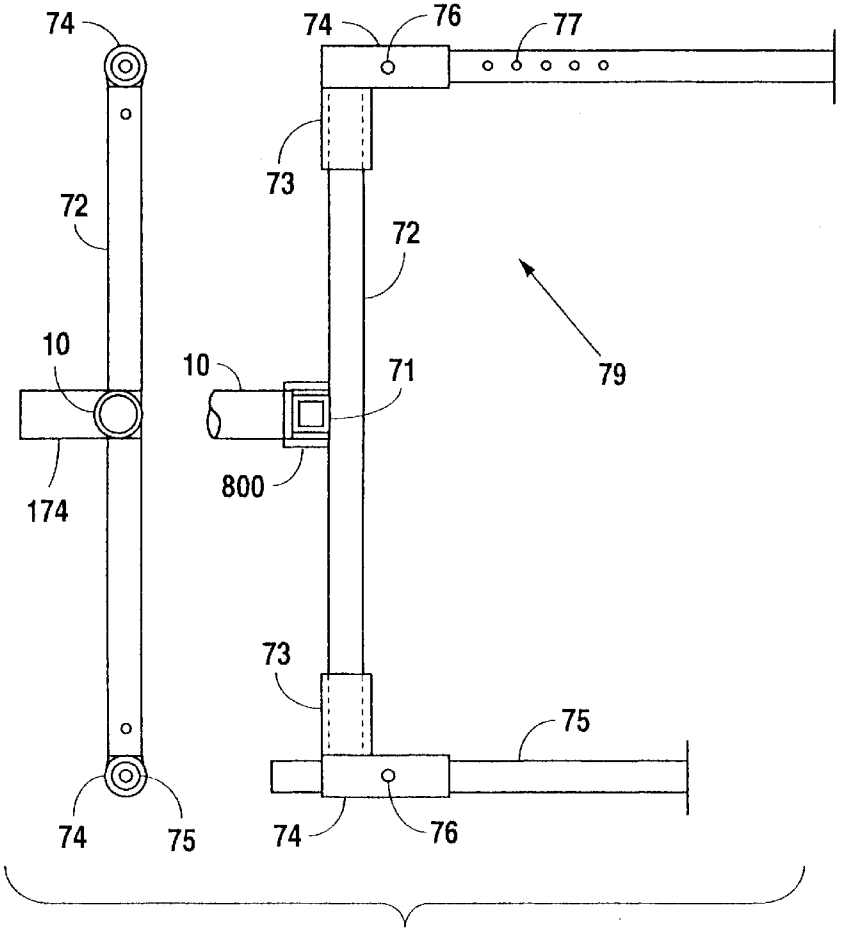
Figure 15B:
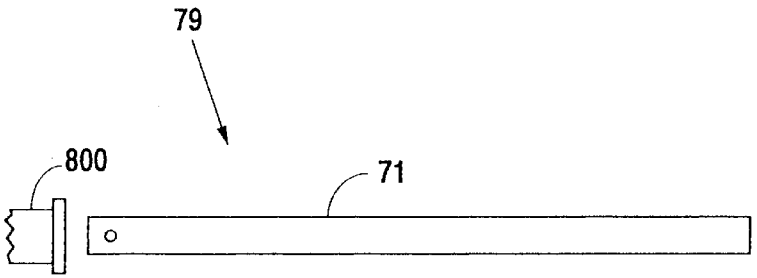
Figure 16A:
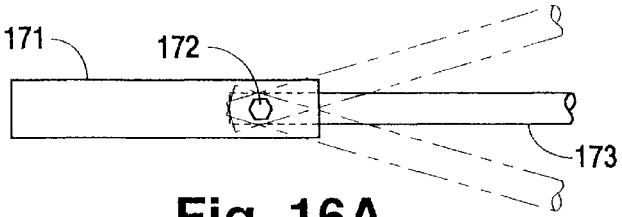
Figure 16B:
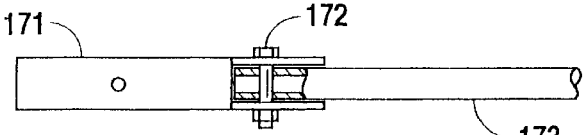

FIGS. 13A, 13B, and 13C are a series of perspective views, illustrating the assembly of the portable hoist system;

FIG. 14 is a side elevational view of the portable hoist system assembled as shown in FIGS. 13A, 13B, and 13C and mounted on a base assembly;

FIG. 15A is a right side elevational view of the portable hoist assembly on a bipod mount for use with the hitch receiver on the back of a truck;

FIG. 15B is a top plan view of the system shown in FIG. 15A;

FIG. 16A is a top plan view of an alternate embodiment of a connection to a hitch receiver; and FIG. 16B is a side elevational view, in partial section, of the connection shown in FIG. 16A.

DESCRIPTION OF THE EMBODIMENTS

Figure 1:
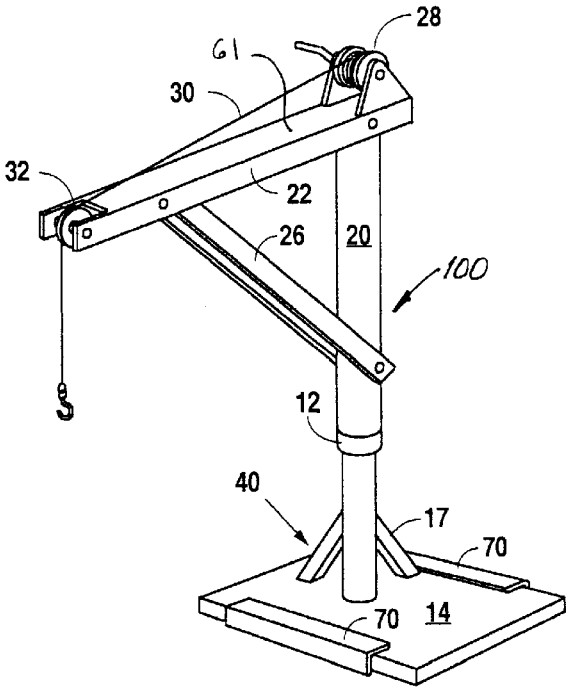
FIG. 1 is a perspective view of a first embodiment of the hoist assembly of the present invention.
Figure 2:
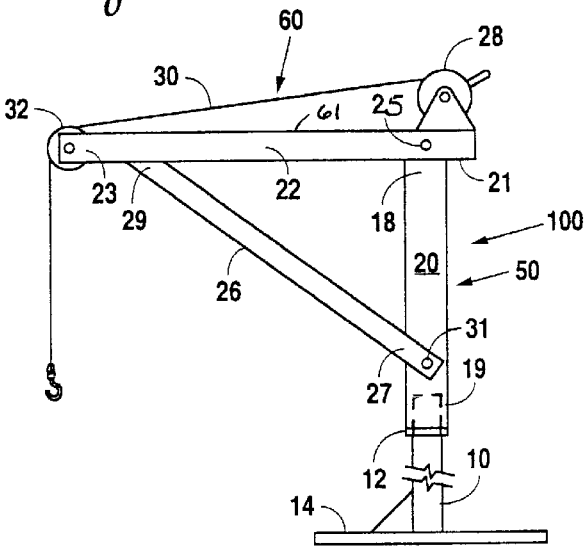
FIG. 2 is a side elevational view of the portable hoist system installed on a pintle on a base as shown in FIG. 1.
Figure 6:
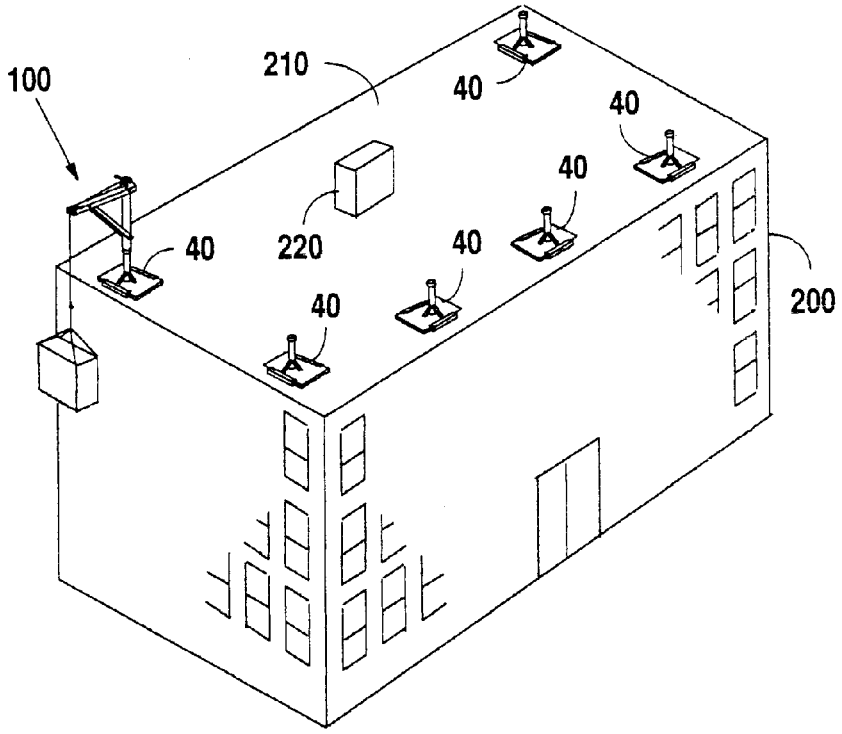
FIG. 6 is a perspective view of a building with the portable hoist system installed on the top thereof.
Figure 7:
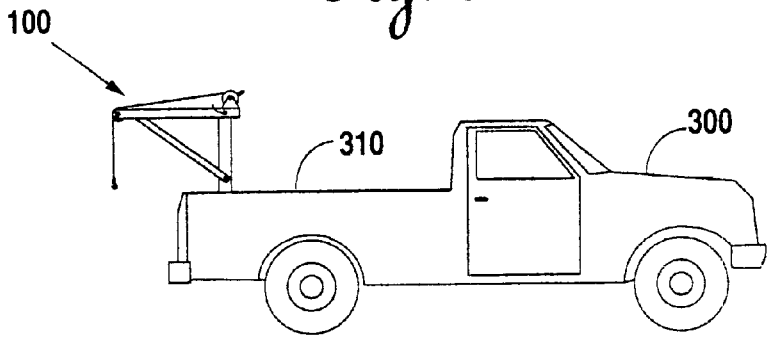
FIG. 7 is a side elevational view of a small pickup style truck including the portable hoist system in its cargo space.
Figure 8:
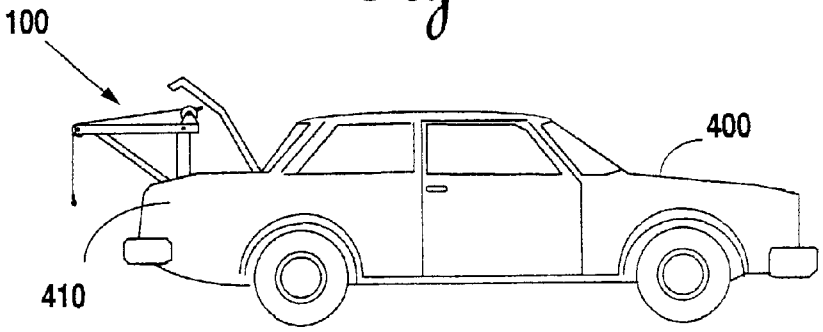
FIG. 8 is a side elevational view of an automobile including the portable hoist system in its trunk.
Figure 10:
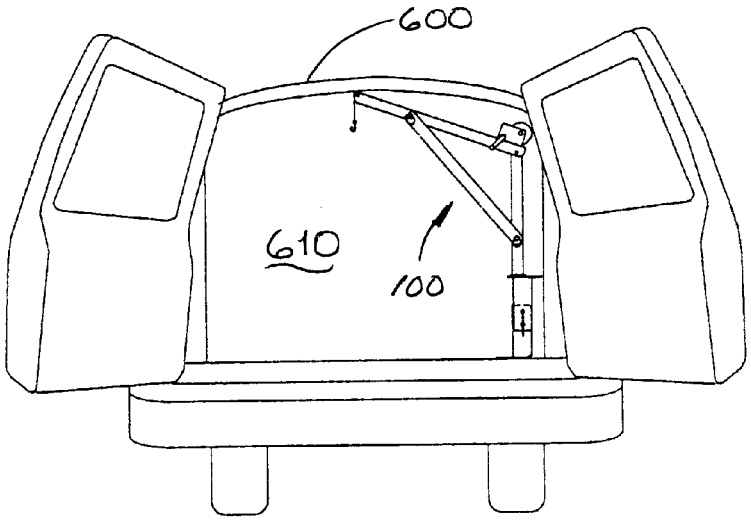
FIG. 10 is a perspective view of the portable hoist system installed in the back of a van.
Figure 11:
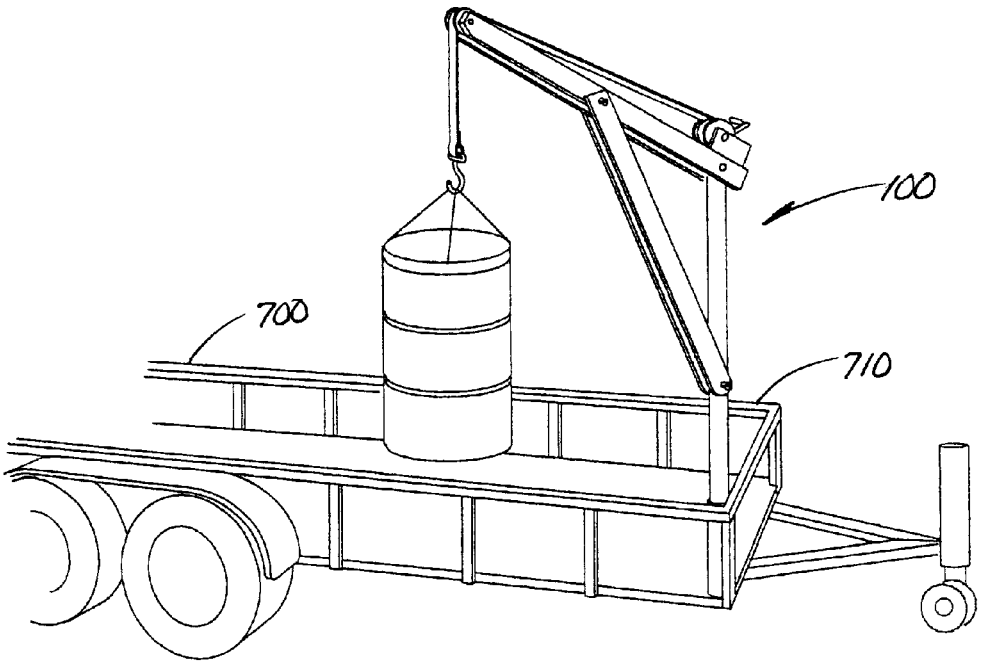
FIG. 11 is a perspective view of the portable hoist system installed on a trailer.

As shown in FIG. 1 and FIG. 2, a key feature of the portable hoist system 100 of the present invention is the base assembly 40. In the first embodiment of the base assembly 40 shown in FIG. 1, a substantially vertical pintle 10 is firmly attached to the top 210 of a building 200 (FIG. 6) or to another type of platform, be it in the open bed 310 of a pickup truck 300 (FIG. 7), in the trunk 400 of an automobile 400 (FIG. 8), in the cargo space 610 of a van 600 (FIG. 10), on the side rail 710 of a trailer 700 (FIG. 11), or other location which provides adequate support for the portable hoist system 100 and any load to be picked up.

As shown in FIG. 1, the pintle 10 is mounted upon a plate 14 which has an extending foot therefrom. In most applications the extending foot may extend outwardly in one direction. When used on the roof 210 of a building 200, the foot will extend away from the edge of the flat roof. Alternatively, the plate 14 may be built into the cargo space of a vehicle or the roof 210 of a building 200 or it may be fit into a mounting system such as the parallel pair of angle iron pieces 70 shown in FIG. 1.

Normally, the pintle 10 will be located on the roof 210 of a building 200 as close as possible to the edge, but far enough away so that it will not normally be seen from the ground level. As shown in FIG. 2, the substantially vertical tube 20 portion of the hoist support assembly 50 is removably telescoped over the pintle 10 for full rotation of the hoist support assembly 50 with respect to the pintle 10. A support arm 22 extends outwardly and substantially horizontally away from a pinned connection 24 on the top portion 18 of the tube 20, but alternatively, and as will be shown below, the support arm 22 may be angled upwardly with respect to the tube 20 as shown in FIGS. 9, 10, 11 and 14. A brace member 26 extends from near the distal end 23 of the arm 22 to the lower portion 19 of tube 20 to hold the support arm 22 in position when weight is placed thereon.

Therefore, when not in use, only the base assembly 40 need remain on the roof of a building, in the bed of a truck, in the trunk of a car, or wherever the hoist assembly 50 is used. However, when necessary, the vertical tube 20, the brace 26, and support arm 22 can be readily carried to the roof 210 of a building 200 or mounted to a vehicle. A cable or strap control assembly 60 is located on the arm 22. The cable or strap control assembly 60 includes a cable or strap 30 which runs from a windlass drum 28 mounted on the top surface 21 of the arm 22 over a guide bar or rotating spool 32 mounted to the distal end 23 of the support arm 22 and extends downwardly to a hook 35, loop, bar, clevis, or other type of hardware selected to best lift the load to be hoisted.

When the portable hoist system 100 is lifting something up along the side of a building, the base assembly 40 will be anchored so that the pintle 10 will not tilt when the load is hoisted. When the lifted object is swung over the roof away from the edge, the base assembly 40 will press downwardly on the roof 210.

Referring to the drawings attached hereto, it may be seen in FIG. 1 that the pintle 10, with an optional stop ring 12 near the bottom thereof (for height adjustment) is supported upon a base plate 14.

FIG. 2 shows the base plate 14 and the stop ring 12; however, the substantially vertical tube 20 is telescoped over the pintle 10 so that the top portion is no longer seen. As shown in FIG. 1, various braces 17 are shown to hold the pintle 10 in an upright or vertical position. Such bracing systems are well known to those of ordinary skill in the art.

Figure 3:
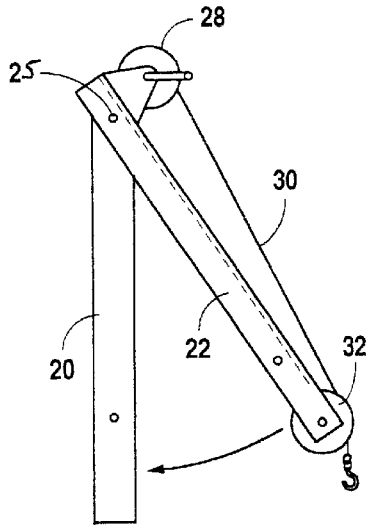
FIG. 3 is a side elevational view of the hoist support assembly in a partially folded condition with the brace removed.

FIG. 2 shows the tube 20 as it is telescoped over the pintle 10. The support arm 22 is pivotably connected to the tube 20 by a bolt or pin 25 which passes through each one of them. Although not explicitly shown it will be understood that the tube 20 can be folded in a parallel fashion to the arm 22. A partially folded hoist support system appears in FIG. 3. The arm 22 is a channel so that the top 18 of the tube 20 fits between the two channel flanges at the proximal end 21 of the arm 22. This enables the hoist support system 50 to be quickly disassembled and carried.

FIG. 2 shows that a brace member 26 extends from the bottom portion 19 of the substantially vertical tube 20 to the distal end 23 of the arm 22. FIG. 2 shows the windlass drum 28 with its hand crank mounted on the top of the arm 22. The cable or strap 30 extends from the windlass drum over a guide bar or rotating spool 32.

According to the embodiment shown in the drawing figures, the first end 27 of the brace member 26 straddles the tube 20. The flanges formed on the first end 27 of the brace member 26 are held thereto by a bolt or pin 31 passing through the flanges on the first end 27 of the brace member 26. The second end 29 of the brace member 26 may be readily positioned by fitting it into a notch (not shown) which has been cut out of the arm 22 to receive the second end 29 of brace member 26. Alternatively, the brace member 26 may be held in position by a bolt or pin extending through both the arm 22 and the brace member 26.

Therefore, it may be seen that a manager or an owner of several buildings or an owner of a vehicle could have the base assembly 40 permanently mounted to the roof 210 of a building 200, in the cargo space of a vehicle, then as the need arises, the hoist support assembly 50 with the cable control assembly 60 attached thereto can be hand carried up to a roof by an individual or installed in the bed 310 of a truck 300, in the trunk 410 of an automobile 400, in an enclosed truck body 500, in a van 600, or in a trailer 700 to create a workable hoist system.

The main purpose and advantage of the present invention is to have a unit which may be conveniently attached to a roof 210, the bed 310 of a truck 300, the trunk 410 of an automobile 400, the inside of a van 600, or the rail around a trailer 700 and which is readily transportable and can be moved and set up by an individual lifting a load.

As will be understood by those of ordinary skill in the art, the portable hoist system 100 can easily be mounted upon any platform such as the deck of a dock, the bed of a trailer, a watercraft, or even an aircraft. A single hoist assembly 100 could be used with a plurality of installed base assemblies 40. For example, a building may include a plurality of base assemblies 40 positioned at various portions on the top 210 of a building 200. A single hoist support assembly 50 could be positioned at various locations by attaching it to one of the pre-installed base assemblies 40. The weight and size of the collapsed hoist support assembly 50 enables it to be easily carried to the roof by an individual on a ladder or to be carried to the roof by an individual using an internal stairway.

The portable hoist system 100 of the present invention is meant only for occasional use. Therefore, a hand crank lockable windlass 28 on the cable or strap control assembly 60 are satisfactory. The windlass 28 is mounted on the top 61 of the support arm 22. If desired, however, the windlass 28 could be a motorized unit. Such motorized units could either be pneumatic or electric. When the lifting job is completed, the hoist support assembly 50 together with the cable control assembly 60 can be quickly removed, the brace member 26 dismantled and the other parts folded up into a neat bundle carried down a ladder or a stairway to the next location. It has been found that a portable hoist system 50 made of structural aluminum weighs about 30 pounds and may have a maximum lifting capacity of nearly 1000 pounds. Aluminum was chosen for the preferred embodiment because it remains cool to the touch even in hot weather, it resists corrosion, and is inexpensive. Alternatively, other high strength, lightweight metals such as titanium may also be used as long as the weight of the hoist support assembly 50 does not exceed the weight easily transportable by an individual.

Figure 4:
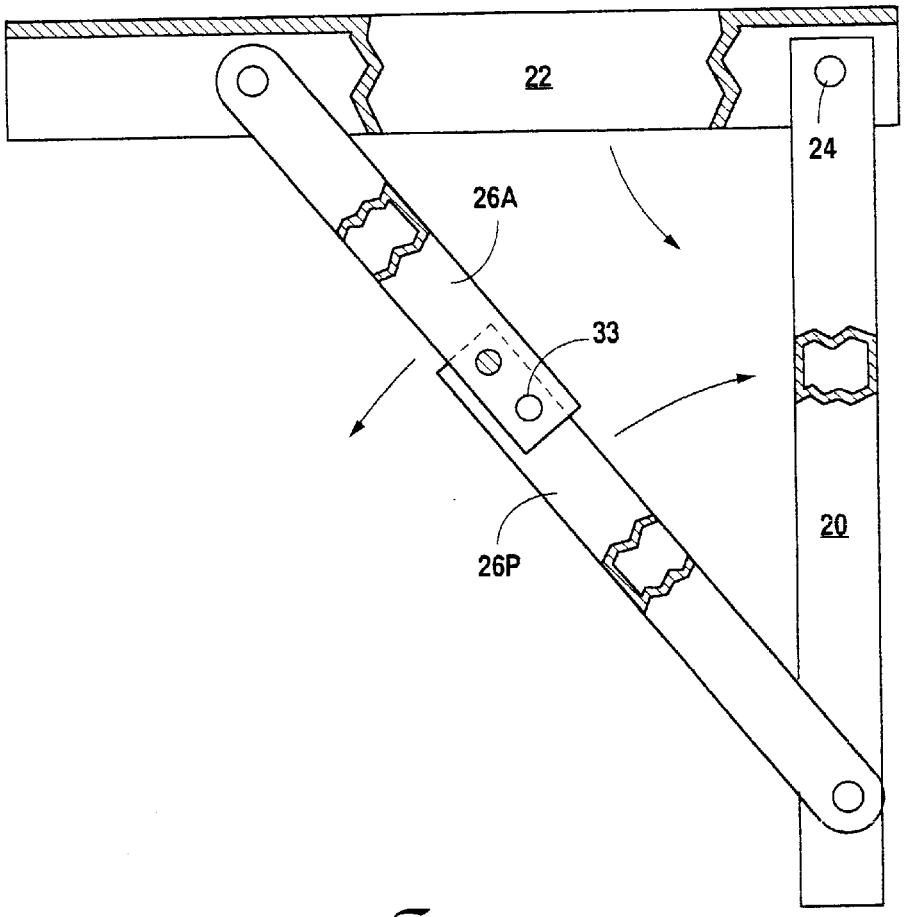
FIG. 4 is a side elevational view, in partial section, of the hoist support assembly with a folding angled brace member.
Figure 5:
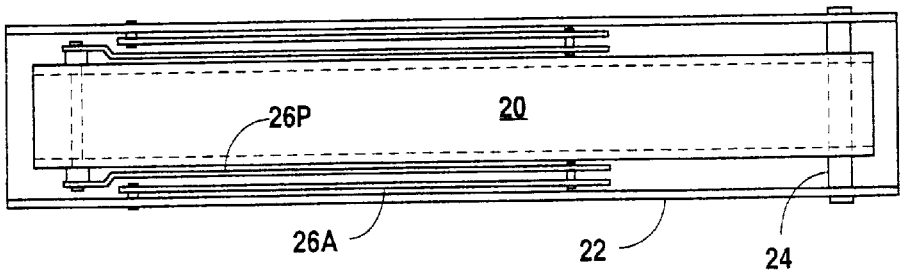
FIG. 5 is a bottom plan view of the support arm shown in FIG. 4 with the folding angled brace member contained therein.

Many variations of the present invention are available. For example, the brace member 26 could be attached to ears (not shown) extending to near the lower portion 19 of the support tube 20. As shown in FIGS. 4 and 5, the brace member 26 could be a two piece 26A, 26P channel which could be permanently attached to the support arm 22 to be foldable into the confines of the larger channel of the support arm 22 and then the tube 20 could be folded within the brace member 26. Specifically, in its working condition, a pull pin 33 would be placed within the middle of the brace member 26 to hold the two parts of the brace member 26A, 26P stiffly together. When it is desired to fold the brace member 26 the pull pin 33 would be removed while all other bolts, hinges, and pins remain in place. As shown specifically in FIG. 5 the substantially vertical tube 20 could also be folded inside the brace member sections 26A, 26P and the brace member sections 26A, 26P would be inside the arm 22. The support arm 22 and the brace member sections 26A, 26P may both be made from channel members. Accordingly, when the long axes of the tube 20, the support arm 22, and the brace member 26 are laid parallel, everything would fold inside the support arm 22. Reassembly of the hoist support assembly 50 would require the insertion of only one pin 33. Folding the hoist support assembly 50 to the carrying position would require the pulling of only one pin 33.

OPERATION

A still better understanding of the portable hoist system of the present invention may be had by a review of its assembly and operation. With specific reference to FIG. 13A, FIG. 13B, FIG. 13C, and FIG. 14, the portable hoist system 50 is folded and held together as a convenient package by use of the lifting strap 30. The folded portable hoist system 50, when disassembled and folded, forms into a package small enough to be placed in the space behind the seat of a pickup truck.

As shown in FIG. 13A assembly of the portable hoist system 50 begins by laying it on its side and loosening the strap 30. This enables the brace member 26 to be removed. The next step is to swing the support arm 22 away from the vertical tube. In the embodiment shown in FIG. 14, the angle between the support arm 22 and the vertical tube 20 is opened up to about 110°.

While the embodiment shown in FIG. 1 and the embodiment shown in FIGS. 9, 10, 11, and 14 have different angles between the support arm 22 and the vertical tube 20, those of ordinary skill in the art will understand that a variety of different angles may be used depending on the needed height at the end of the support arm 22. Such selection of angles is facilitated by a set of holes 99 formed in the support arm 22 as shown in FIG. 14.

Once the angle between the vertical tube 20 and the support arm 22 has been opened up, the brace member 26 is attached to both the vertical tube 20 and the support arm 22 using pins or threadable fasteners 31. The strap 30 is then extended over a guide bar or a rotating spool 32 at the end of the support arm 22.

Figure 9:
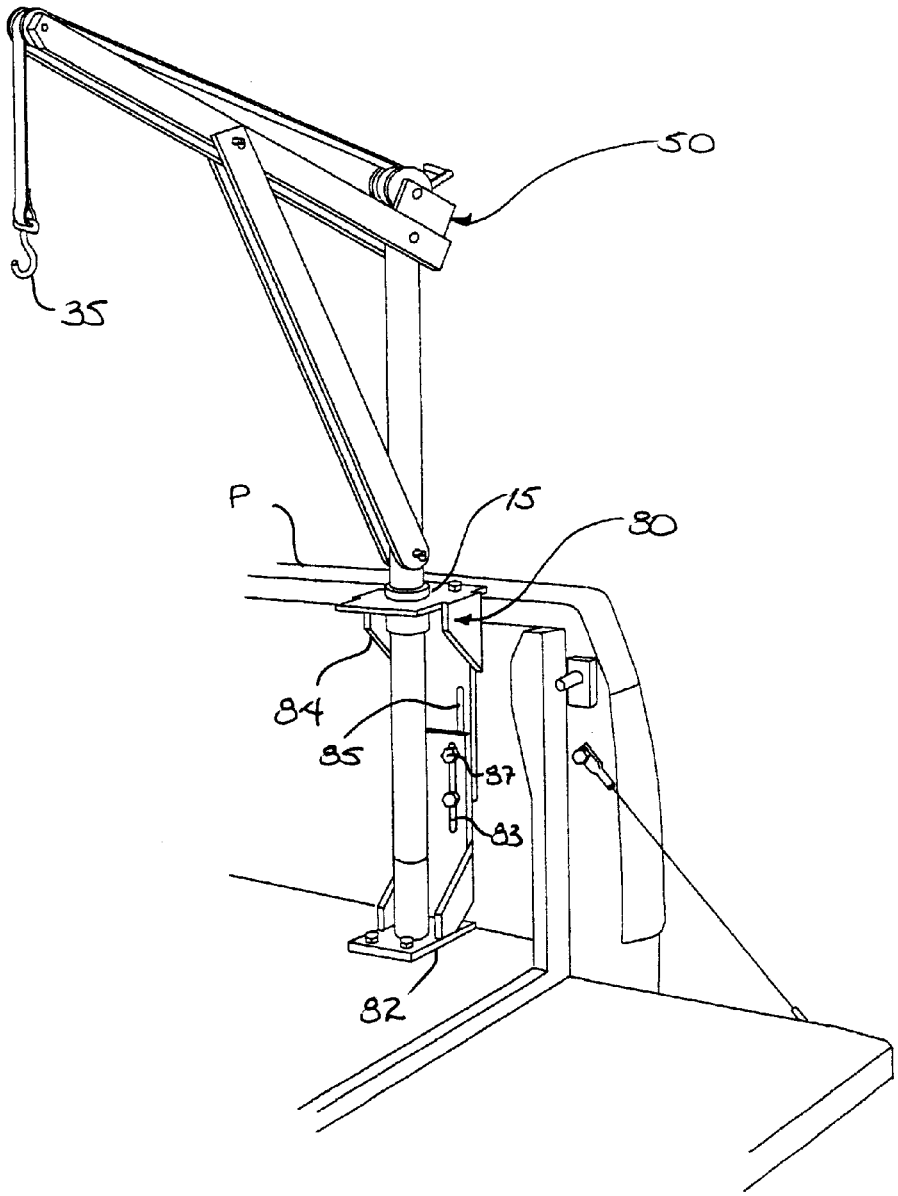
FIG. 9 is a perspective view of the portable hoist system installed in the cargo space of a pick-up truck using a first alternate embodiment of the base assembly.
Figure 12:
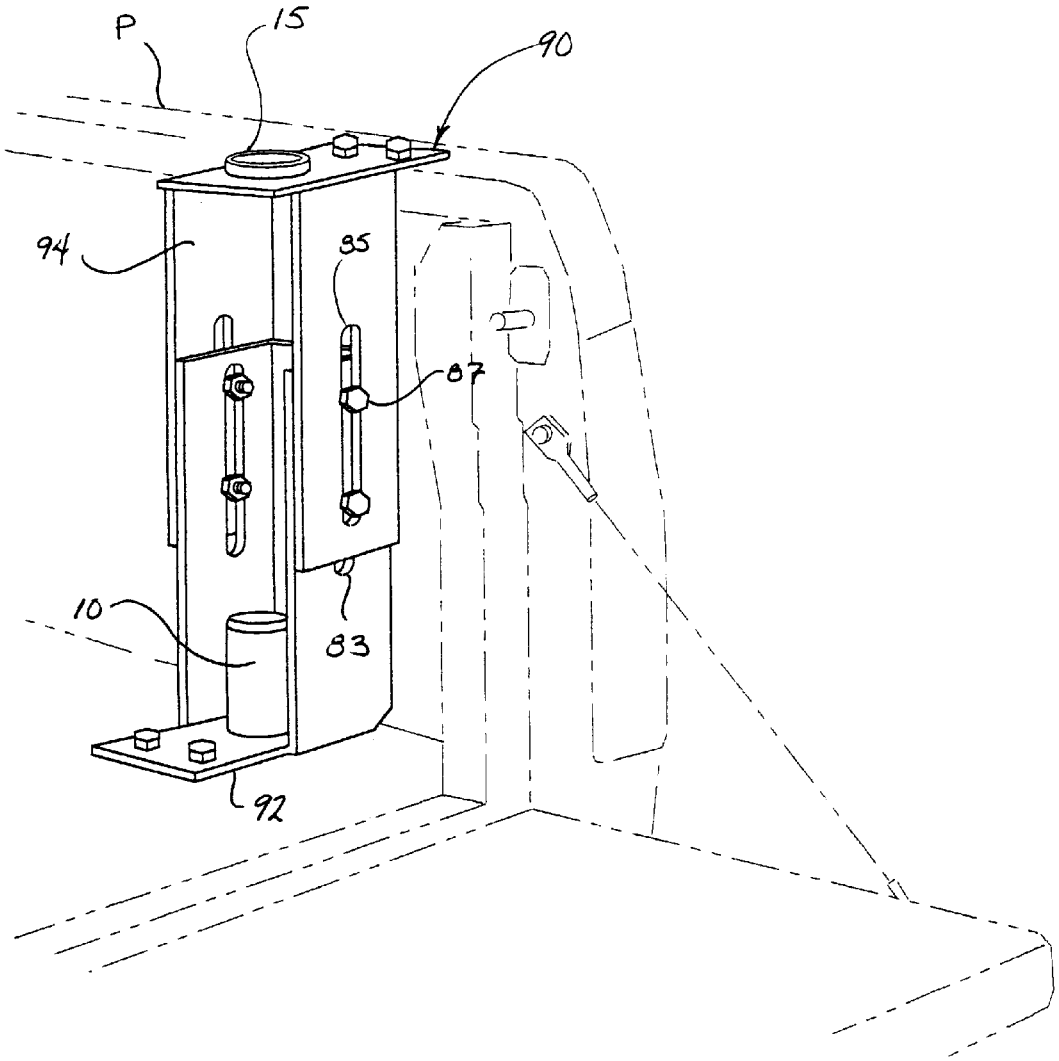
FIG. 12 is a perspective view of a second alternate embodiment of the base assembly.

Once set up, the vertical tube 20 is placed either onto a pintle 10 on a base assembly 40 as shown in FIG. 1 or inserted into a first embodiment of a base assembly 80 as shown in FIG. 9 or an alternate embodiment of a base assembly 90 as shown in FIG. 12. This mounting will enable the portable hoist to swing in a full circle. For example, when the hoist assembly 50 is mounted in the cargo space of a truck as shown in either FIG. 9 or FIG. 14, the vertical tube 20 is positioned by sliding first through an upper ring 15 before engaging the pintle 10. Alternatively, the hoist assembly 50 may be mounted to a base assembly extending outwardly from the tow-hitch receiver found on many pick-up trucks or automobiles, as shown in FIGS. 15, 15B, 16A and 16B.

The holster style base as shown in either FIG. 9 or in FIG. 12 is formed from two pieces. The first or lower piece 82, 92 is typically bolted to a horizontal surface such as the floor of the bed of a pickup truck. Note that a pintle is included for insertion into the bottom of the support tube 20.

The second or upper piece 84, 94 of the holster base includes provisions for mounting to a substantially vertical surface and/or to the top of the cargo space side panel P. Included at the top of the upper piece 84, 94 is a ring 15 oriented to be substantially horizontal. The bottom of the vertical tube 20 is guided through the ring 15 for eventual engagement with the pintle 10. If desired, an additional brace member (not shown) may be used with the holster style brace 80, 90. The slot or slots 83 in lower piece 82, 92 are located to be aligned with the slot or slots 85 in the upper piece 84, 94. Once height adjusted, the lower piece 82, 92 and the upper piece 84, 94 are held in position one to another by a nut and bolt assembly 87.

FIGS. 15A and 15B is shown yet another mounting assembly 79 for the hoist support assembly 50. Many trucks have a hitch receiver 800 mounted to the frame which includes a substantially square open section of tubing extending from the rear of the truck. In FIGS. 15A and 15B, an extension arm 71 is inserted into the hitch receiver 800. The extension arm 71 is mounted to a cross bar 72. The cross bar 72 is inserted into receivers 73 on either end. The receivers are mounted to sleeves 74. Extending through the sleeves are legs 75. By use of pins 76 and a series of holes 77, the legs 75 may be positioned to support the cross bar 72 in a substantially horizontal position. Affixed to the top of the extension arm 71 is either a pintle 10 or a section of pipe for engagement with the support tube 20. If a pintle 10 is used, the support tube 20 is slid over the pintle 10. If a section of pipe is used, the support tube 20 may be inserted into the section of pipe.

In yet another alternate embodiment, as shown in FIGS. 16A and 16B, a shortened extension arm 171 may be used.

At the end of the shortened extension arm 171 is a pivotable connection 172 so that the hoist support assembly 79 for use with a hitch receiver may be moved from side to side at the back of the truck. Shown in phantom in FIG. 16A are alternate positions of the support number 173 which is inserted into the sleeve 174 attached to crossbar 72.

While an open hook 35 is shown on the end of the strap 30, those of ordinary skill will understand that a variety of different lifting devices may be attached at the end of the strap 30 to include closed hooks, plate grippers, lifting bars, or a clevis.

Those of ordinary skill in the art will also realize that two or more hoists may be used with one vehicle to lift particularly heavy loads, off-balance loads, or exceptionally large equipment.

Once installed, the portable hoist system 100 of the present invention may be used to lift a variety of different loads heretofore not movable by a single person. Such loads may include, but is not limited to:

palletized loads
small yard machines
tree stumps
automobile engines
farm equipment
large truck tires
furniture
small off-road vehicles
deer
generators
large poles
small watercraft
rocks
small motorcycles
fuel/oil drums
appliances Once the lifted item has been placed in the bed of a pickup truck, in a van, in a car, or into the cargo space of any type of vehicle in which it used, the portable hoist assembly 100 of the present invention is simply lifted from its mounting and configured for storage. Specifically, the pins or bolts used to connect the support arm to the brace member are removed. The pins or bolts 31 used to connect the brace member 26 to the substantially vertical tube 20 are also removed. The three parts 20, 22, 26 of the hoist may then be nested together. As the open portion of the channel section brace member 26 is wider than the support arm 22, the support arm 22 may be nested in the channel. Further, since the open section of the channel section support arm 22 is wider than the substantially vertical tube 20, the substantially vertical tube 20 may be nested therein. Once nested together, the strap 30 may be wrapped around the nested parts to both hold them together and provide a convenient carrying handle. For security, the disassembled hoist assembly 50 can be placed within a vehicle at a secure location. When it is necessary to remove the load from the cargo space of the vehicle, the hoist is re-assembled and mounted on the base to lift the transported cargo.

Those of ordinary skill in the art will understand that numerous improvements and modifications may be made to the disclosed portable hoist system without departing from the scope of the invention. Such improvements and modifications may include, but are not limited to:

adding a motor drive or power assist to the winch assembly;

adding a weight indicator;

including a ratchet system in the connection between the substantially vertical tube and the support base;

including a bearing connection such as a ball bearing in the connection between the substantially vertical tube and the support base;

including a light system for night operations;

adding a motor drive or power assist to assist in the rotation of the hoist support assembly about the base;

reinforcing the support arm with a thicker cross section at its distal end.

Still other improvements may be made without departing the basic invention disclosed herein. Such other improvements shall fall within the scope and meaning of the appended claims.

What is claimed is:

1. A portable hoist system which may be carried and erected by an individual, said portable hoist system comprising:

a base assembly, said base assembly including a pintle;

a hoist support assembly, said hoist support assembly including:

a substantially vertical tube having a bottom portion, a top portion, and a long axis, said bottom portion being constructed and arranged to rotatably engage said pintle;

a channel section support arm having a proximal end, a distal end, a top surface, and a long axis, said proximal end being constructed and arranged to be affixed to said top portion of said substantially vertical tube;

a channel section angle brace member having a first end, a second end, and a long axis, said first end being constructed and arranged to be affixed to said bottom portion of said substantially vertical tube, and said second end being constructed and arranged to be affixed to said distal end of said channel section support arm;

a lifting strap control assembly, said lifting strap control assembly including:

a windlass mounted at said proximal end and on said top surface of said channel section support arm;

a lifting strap guide bar mounted at said distal end of said support arm;

a lifting strap having sufficient length to both be wrapped around said windlass and to pass around said lifting strap guide bar;

said hoist support assembly being constructed and arranged to be collapsible whereby the long axes of said substantially vertical tube, said channel section support arm, and said channel section angle brace member become parallel one to another;

said hoist support assembly being constructed out of a light metal so as to be transportable by an individual.

2. The portable hoist system as defined in claim 1 wherein said pintle further includes a stop ring.

3. The portable hoist system as defined claim 1 wherein said connection of said top portion of said support arm and said substantially vertical tube is a pivotable connection.

4. The portable hoist system as defined in claim 1 wherein said angle brace member is foldable at a central pivotable connection.

5. The portable hoist system as defined in claim 1 wherein said angle brace member is foldable within said support arm.

6. A portable hoist system for use on the top of a building, said portable hoist system comprising:

a plurality of base assemblies mounted to the top of the building, each of said base assemblies including a plate and a pintle extending upwardly from said plate;

at least one hoist support assembly, said at least one hoist assembly including:

a substantially vertical tube having a bottom portion, a top portion, and a long axis, said bottom portion being constructed and arranged to rotatably engage said pintle;

a channel section support arm having a proximal end, a distal end, and a long axis, said proximal end being constructed and arranged to engage said top portion of said substantially vertical tube;

a channel section angle brace member having a first end, a second end, and a long axis, said first end being constructed and arranged to engage said bottom portion of said substantially vertical tube, and said second end being constructed and arranged to engage said distal end of said channel section support arm;

a lifting strap control assembly, said lifting strap control assembly including:

a windlass mounted at said proximal end and on the top of said channel section support arm;

a lifting strap guide bar mounted at said distal end of said support arm;

a lifting strap having sufficient length to both be wrapped around said windlass and passed around said lifting strap guide bar;

said hoist support assembly being constructed and arranged to be collapsible whereby the long axes of said substantially vertical tube, said channel section support arm, and said channel section angle brace member become parallel to one another;

said at least one hoist support being constructed out of a light metal to be transportable to the top of the building by an individual;

wherein said at least one hoist support assembly may be selectively mounted on one of said plurality of base assemblies positioned at various locations on the top of the building by engaging said substantially vertical tube with said pintle on a selected base assembly.

7. A portable hoist system for use by an individual to lift loads into and remove loads from the cargo space of a vehicle, said portable hoist system comprising:

at least one base assembly constructed and arranged for mounting in the cargo space of the vehicle, said base assembly including a pintle;

at least one hoist support assembly, said at least one hoist assembly including:

a substantially vertical tube having a bottom portion, a top portion, and a long axis, said bottom portion being constructed and arranged to rotatably engage said pintle;

a channel section support arm having a proximal end, a distal end, and a long axis, said proximal end being constructed and arranged to engage said top portion of said substantially vertical tube;

a channel section angle brace member having a first end, a second end, and a long axis, said first end being constructed and arranged to engage said bottom portion of said substantially vertical tube, and said second end being constructed and arranged to engage said distal end of said channel section support arm;

a lifting strap control assembly, said lifting strap control assembly including:

a windlass mounted at said proximal end of said channel section support arm;

a lifting strap guide bar mounted at said distal end of said channel support arm;

a lifting strap having sufficient length to both be wrapped around said windlass and passed around said lifting strap guide bar;

said at least one hoist assembly being constructed and arranged to be collapsible whereby the long axes of said substantially vertical tube, said channel section support arm, and said channel section angle brace become parallel to one another;

said hoist support assembly being constructed out of a light metal so as to be capable of being constructed and them mounted on said at least one base assembly in the cargo space of the vehicle by an individual.

8. The portable hoist system as defined in claim 1 wherein the height of said base assembly is adjustable.

9. A method for constructing a portable hoist system which may be carried and erected by an individual and then rotatably mounted on a pintle, said method comprising the steps of:

(a) fabricating a hoist support assembly, said hoist support assembly including:

a substantially vertical tube having a bottom portion, and a top portion, said bottom portion being constructed and arranged to rotatably engage said pintle;

a channel section support arm having a proximal end, and a distal end, said proximal end being constructed and arranged to engage said top portion of said substantially vertical tube;

a channel section angle brace member having a first end and a second end, said first end being constructed and arranged to engage said bottom portion of said substantially vertical tube and said second end being constructed and arranged to engage said distal end of said cross section support arm;

(b) attaching a lifting strap control assembly to said support arm, said lifting strap control assembly including:

a windlass mounted at said proximal end of said channel section support arm;

a lifting strap guide bar mounted at said distal end of said channel section support arm;

a lifting strap having sufficient length to both be wrapped around said windlass and passed around said lifting strap guide bar;

(c) positioning the combination of said hoist support assembly and said cable control assembly on the pintle by sliding said substantially vertical tube over said pintle.

* * * * *